US009920774B2

(12) United States Patent
Ghasripoor et al.

(10) Patent No.: US 9,920,774 B2
(45) Date of Patent: Mar. 20, 2018

(54) PRESSURE EXCHANGE SYSTEM WITH MOTOR SYSTEM AND PRESSURE COMPENSATION SYSTEM

(71) Applicant: Energy Recovery, Inc., San Leandro, CA (US)

(72) Inventors: Farshad Ghasripoor, Berkeley, CA (US); Jeremy Grant Martin, Oakland, CA (US); David D. Anderson, Castro Valley, CA (US); Alexander Patrick Theodossiou, San Francisco, CA (US); Adam Rothschild Hoffman, San Francisco, CA (US); Mark Richter, Orinda, CA (US); Patrick William Morphew, San Leandro, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 0 days.

(21) Appl. No.: 15/240,755

(22) Filed: Aug. 18, 2016

(65) Prior Publication Data

US 2017/0051762 A1 Feb. 23, 2017

Related U.S. Application Data

(60) Provisional application No. 62/208,100, filed on Aug. 21, 2015.

(51) Int. Cl.
*F04F 99/00* (2009.01)
*F04F 13/00* (2009.01)
(Continued)

(52) U.S. Cl.
CPC ..... *F04F 13/00* (2013.01); *E21B 43/26* (2013.01); *E21B 43/267* (2013.01); *F05B 2240/20* (2013.01); *F05B 2240/57* (2013.01)

(58) Field of Classification Search
CPC ..... F04F 13/00; F16J 15/164; F04B 47/06; F04B 47/00
USPC ..... 417/64, 414
See application file for complete search history.

(56) References Cited

U.S. PATENT DOCUMENTS 1,879,628 A * 9/1932 Mendenhall ..... H02K 5/132 277/428
2,740,908 A * 4/1956 Dochterman ..... H02K 5/132 310/87

(Continued)

FOREIGN PATENT DOCUMENTS

GB 644812 A 10/1950
WO WO 2016/053658 * 4/2016

OTHER PUBLICATIONS

PCT International Search Report and Written Opinion; Application No. PCT/US2016/047794; Dated Nov. 16, 2016; 11 pages.

*Primary Examiner* — Charles Freay
(74) *Attorney, Agent, or Firm* — Fletcher Yoder, P.C.

(57) ABSTRACT

A system includes a hydraulic energy transfer system configured to exchange pressures between a first fluid and a second fluid. The system also includes a motor system configured to power the hydraulic energy transfer system and a shaft coupling the motor system and the hydraulic energy transfer system. Additionally, the system includes a shaft seal disposed about the shaft. Further, the system includes a pressure compensator configured to reduce a pressure differential across the shaft seal.

16 Claims, 6 Drawing Sheets

(51) Int. Cl.
*E21B 43/26* (2006.01)
*E21B 43/267* (2006.01)

(56) References Cited

U.S. PATENT DOCUMENTS

| | | | | | |
|---|---|---|---|---|---|
| 2,766,928 | A * | 10/1956 | Boszormenyi | F04F 13/00 | 415/134 |
| 3,289,595 | A * | 12/1966 | Bach | F04D 13/062 | 310/54 |
| 3,431,747 | A * | 3/1969 | Hashemi | B01D 61/06 | 417/339 |
| 4,558,247 | A * | 12/1985 | Yamamoto | H02K 5/1285 | 310/87 |
| 4,614,482 | A * | 9/1986 | Gaffal | F04D 13/062 | 417/367 |
| 4,838,234 | A * | 6/1989 | Mayer | F02B 33/42 | 123/559.2 |
| 4,952,848 | A * | 8/1990 | Erhardt | H05B 41/288 | 315/244 |
| 6,242,829 | B1 * | 6/2001 | Scarsdale | E21B 4/003 | 310/87 |
| 7,207,781 | B2 * | 4/2007 | Shumway | B01D 61/06 | 210/321.65 |
| 8,336,631 | B2 * | 12/2012 | Shampine | E21B 43/267 | 166/105 |
| 8,807,966 | B2 * | 8/2014 | Du | F04D 13/10 | 417/414 |
| 2006/0037907 | A1 | 2/2006 | Shumway | | |
| 2014/0048143 | A1 | 2/2014 | Lehner et al. | | |

* cited by examiner 10
40
42
44
46
48
50
52
54
56
58
60
62
64
66
68
70
72
74
76
78
80
82
84
86
88
90

PRESSURE EXCHANGE SYSTEM WITH MOTOR SYSTEM AND PRESSURE COMPENSATION SYSTEM

CROSS-REFERENCE TO RELATED APPLICATIONS

This application claims priority to and the benefit of U.S. Provisional Application No. 62/208,100, entitled "PRESSURE EXCHANGE SYSTEM WITH MOTOR SYSTEM AND PRESSURE COMPENSATION SYSTEM," filed Aug. 21, 2015, the disclosure of which is hereby incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Well completion operations in the oil and gas industry often involve hydraulic fracturing (often referred to as fracking or fracing) to increase the release of oil and gas in rock formations. Hydraulic fracturing involves pumping a fluid (e.g., frac fluid) containing a combination of water, chemicals, and proppant (e.g., sand, ceramics) into a well at high pressures. The high pressures of the fluid increases crack size and crack propagation through the rock formation to release oil and gas, while the proppant prevents the cracks from closing once the fluid is depressurized. Fracturing operations use high-pressure pumps to increase the pressure of the frac fluid. Unfortunately, the proppant in the frac fluid may interfere with the operation of the rotating equipment. In certain circumstances, the solids may slow or prevent the rotating components from rotating.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
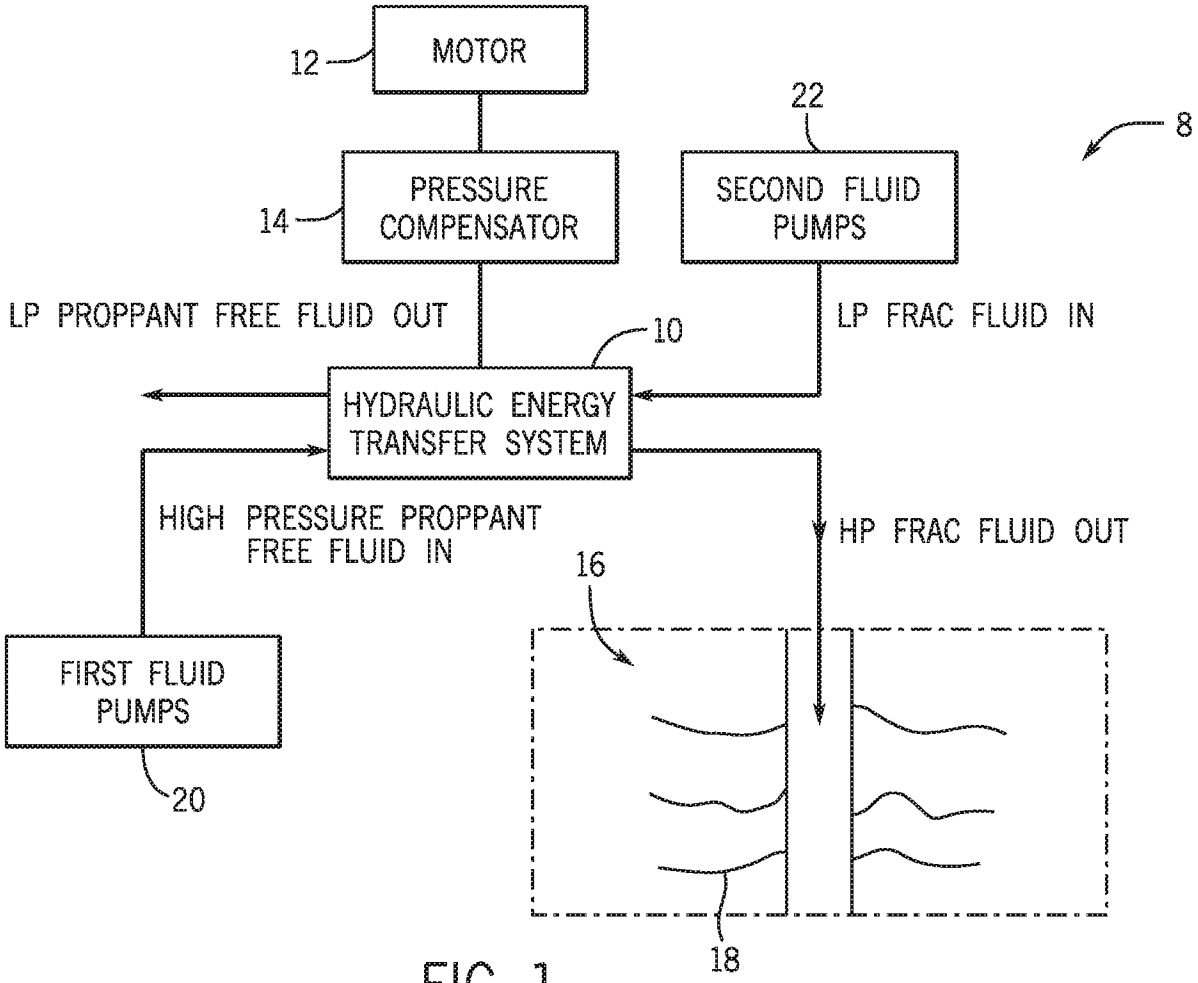
FIG. 1 is a schematic diagram of an embodiment of a hydraulic energy transfer system with a motor system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, a fluid handling system, such as a frac system or hydraulic fracturing system, includes a hydraulic energy transfer system that transfers work and/or pressure between a first fluid (e.g., a pressure exchange fluid, such as a substantially proppant free fluid) and a second fluid (e.g., frac fluid, such as a proppant-laden fluid). These fluids may be multi-phase fluids such as gas/liquid flows, gas/solid particulate flows, liquid/solid particulate flows, gas/liquid/solid particulate flows, or any other multi-phase flow. For example, the multi-phase fluids may include sand, solid particles, powders, debris, ceramics, or any combination therefore. These fluids may also be non-Newtonian fluids (e.g., shear thinning fluid), highly viscous fluids, non-Newtonian fluids containing proppant, or highly viscous fluids containing proppant. Further, the first fluid may be at a first pressure between approximately 5,000 kPa to 25,000 kPa, 20,000 kPa to 50,000 kPa, 40,000 kPa to 75,000 kPa, 75,000 kPa to 100,000 kPa or greater than a second pressure of the second fluid. In operation, the hydraulic energy transfer system may or may not completely equalize pressures between the first and second fluids. Accordingly, the hydraulic energy transfer system may operate isobarically, or substantially isobarically (e.g., wherein the pressures of the first and second fluids equalize within approximately +/−1, 2, 3, 4, 5, 6, 7, 8, 9, or 10 percent of each other).

The hydraulic energy transfer system may also be described as a hydraulic protection system a hydraulic buffer system, or a hydraulic isolation system, because it blocks or limits contact between a frac fluid and various hydraulic fracturing equipment (e.g., high-pressure pumps), while still exchanging work and/or pressure between the first and second fluids. By blocking or limiting contact between various pieces of hydraulic fracturing equipment and the second fluid (e.g., proppant containing fluid), the hydraulic energy transfer system reduces abrasion and wear, thus increasing the life and performance of this equipment (e.g., high-pressure pumps). Moreover, the hydraulic energy transfer system may enable the frac system to use less expensive equipment in the fracturing system, for example, high-pressure pumps that are not designed for abrasive fluids (e.g., frac fluids and/or corrosive fluids). In some embodiments, the hydraulic energy transfer system may be a rotating isobaric pressure exchanger (e.g., rotary IPX). Rotating isobaric pressure exchangers may be generally defined as devices that transfer fluid pressure between a high-pressure inlet stream and a low-pressure inlet stream at efficiencies in excess of approximately 50%, 60%, 70%, 80%, or 90% without utilizing centrifugal technology.

To facilitate rotation, the hydraulic energy transfer system may couple to a motor system (e.g., an out-board motor system) or may include a motor system within a casing of the hydraulic energy transfer system (e.g., an in-board motor system). For example, the motor system may include an electric motor, a hydraulic motor, a pneumatic motor, another rotary drive, or a combination thereof. In operation, the motor system enables the hydraulic energy transfer system to rotate with highly viscous and/or fluids that have solid particles, powders, debris, etc. For example, the motor system may facilitate startup with highly viscous or particulate-laden fluids, which enables a rapid start of the hydraulic energy transfer system. The motor system may also provide additional force that enables the hydraulic energy transfer system to grind through particulate to maintain a proper operating speed (e.g., rpm) with a highly viscous/particulate laden fluid. Additionally, the motor system may also substantially extend the operating range of the hydraulic energy transfer system. For example, the motor system may enable the hydraulic energy transfer to operate with good performance at lower or higher flow rates than a "free-wheeling" hydraulic energy transfer system without a motor system, because the motor system may facilitate control of the speed (e.g., rotating speed) of the hydraulic energy transfer system and control of the degree of mixing between the first and second fluids.

As noted above, the hydraulic energy transfer system may include an in-board motor system or may couple to an out-board motor system. However, process fluid of the hydraulic energy transfer system (e.g., high pressure first fluid or high pressure second fluid) may enter the in-board motor system and may damage components, such as electrical components, of the motor system. Further, the out-board motor system may include a shaft seal about the shaft coupling the out-board motor system to the hydraulic energy transfer system to reduce, minimize, or block leakage of the process fluid of the hydraulic energy transfer system into the out-board motor system. However, the shaft seal may be exposed to a very high pressure differential (e.g., up to 10,000 kPa or greater) and particulates from the high pressure particle-laden fluid, which may wear and/or degrade the seal, cause leakage of process fluid across the seal, and/or cause the seal to extrude and/or fail.

As will be described in more detail below, the present embodiments include a motor system (e.g., an out-board motor system) that is coupled to the hydraulic energy transfer system via a shaft and a shaft seal and that includes a high pressure dielectric fluid and a pressure compensator (e.g., pressure balancer, pressure equalizer, etc.). In particular, the pressure compensator may contain high pressure dielectric fluid from the motor system and high pressure process fluid (e.g., high pressure first fluid and/or the high pressure second fluid) from the hydraulic energy transfer system and may equalize or balance the pressure between the high pressure dielectric fluid and the high pressure process fluid. By equalizing or balancing the pressure between the high pressure dielectric fluid and the high pressure process fluid, the pressure compensator may reduce or minimize a pressure differential between a first face of the shaft seal facing the motor system and a second face of the shaft seal facing the hydraulic energy transfer system. As such, the pressure compensator may enable the use of a low pressure shaft seal (e.g., between 500 kPa to 2,000 kPa) and may reduce leakage of fluid across the shaft seal. Further, the pressure compensator may reduce wear and degradation of the shaft seal and may reduce the occurrence of extrusion of the shaft seal, which may increase the lifespan of the shaft seal.

FIG. 1 is a schematic diagram of an embodiment of a fluid handling system 8 (e.g., frac system) with a hydraulic energy transfer system 10 coupled to a motor system 12. As explained above, the motor system 12 facilitates rotation of the hydraulic energy transfer system 10 when using highly viscous and/or particulate laden fluids. The fluid handling system 8 also includes a pressure compensator 14 (e.g., a pressure compensation system, pressure balancer, pressure equalizer, etc.) that is in hydraulic communication with a high pressure dielectric fluid of the motor system 12 and in hydraulic communication with a high pressure process fluid of the hydraulic energy transfer system 10. As will be described in more detail below, the pressure compensator 14 may balance or equalize the pressures of the high pressure dielectric fluid and the high pressure process fluid to reduce a pressure differential across a shaft seal coupling the motor system 12 to the hydraulic energy transfer system 10.

In the illustrated embodiment, the fluid handling system 8 is a frac system. However, it should be appreciated that the fluid handling system 8 may be any suitable system configured to handle an abrasive (e.g., particulate laden) fluid. For example, the fluid handling system 8 and the hydraulic energy transfer system 10 may configured for water re-injection for well recovery and fluid transportation using the hydraulic energy transfer system 10 as a pump. In embodiments in which the fluid handling system is a frac system 8, the frac system 8 pumps a pressurized particulate-laden fluid that increases the release of oil and gas in rock formations 16 by propagating and increasing the size of cracks 16. In order to block the cracks 18 from closing once the frac system 8 depressurizes, the frac system 8 uses fluids that have solid particles, powders, debris, etc. that enter and keep the cracks 18 open.

In order to pump this particulate laden fluid into the well, the frac system 8 may include one or more first fluid pumps 20 (e.g., high pressure pumps) and one or more second fluid pumps 22 (e.g., low pressure pumps) coupled to the hydraulic energy transfer system 10. For example, the hydraulic energy transfer system 10 may be a rotary IPX. In operation, the hydraulic energy transfer system 10 transfers pressures without any substantial mixing between a first fluid (e.g., proppant free fluid) pumped by the first fluid pumps 20 and a second fluid (e.g., proppant containing fluid or frac fluid) pumped by the second fluid pumps 22. In this manner, the hydraulic energy transfer system 10 blocks or limits wear on the first fluid pumps 20 (e.g., high pressure pumps), while enabling the frac system 8 to pump a high pressure frac fluid into the well 16 to release oil and gas. In order to operate in corrosive and abrasive environments, the hydraulic energy transfer system 10 may be made from materials resistant to corrosive and abrasive substances in either the first and second fluids. For example, the hydraulic energy transfer system 10 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

Figure 2:
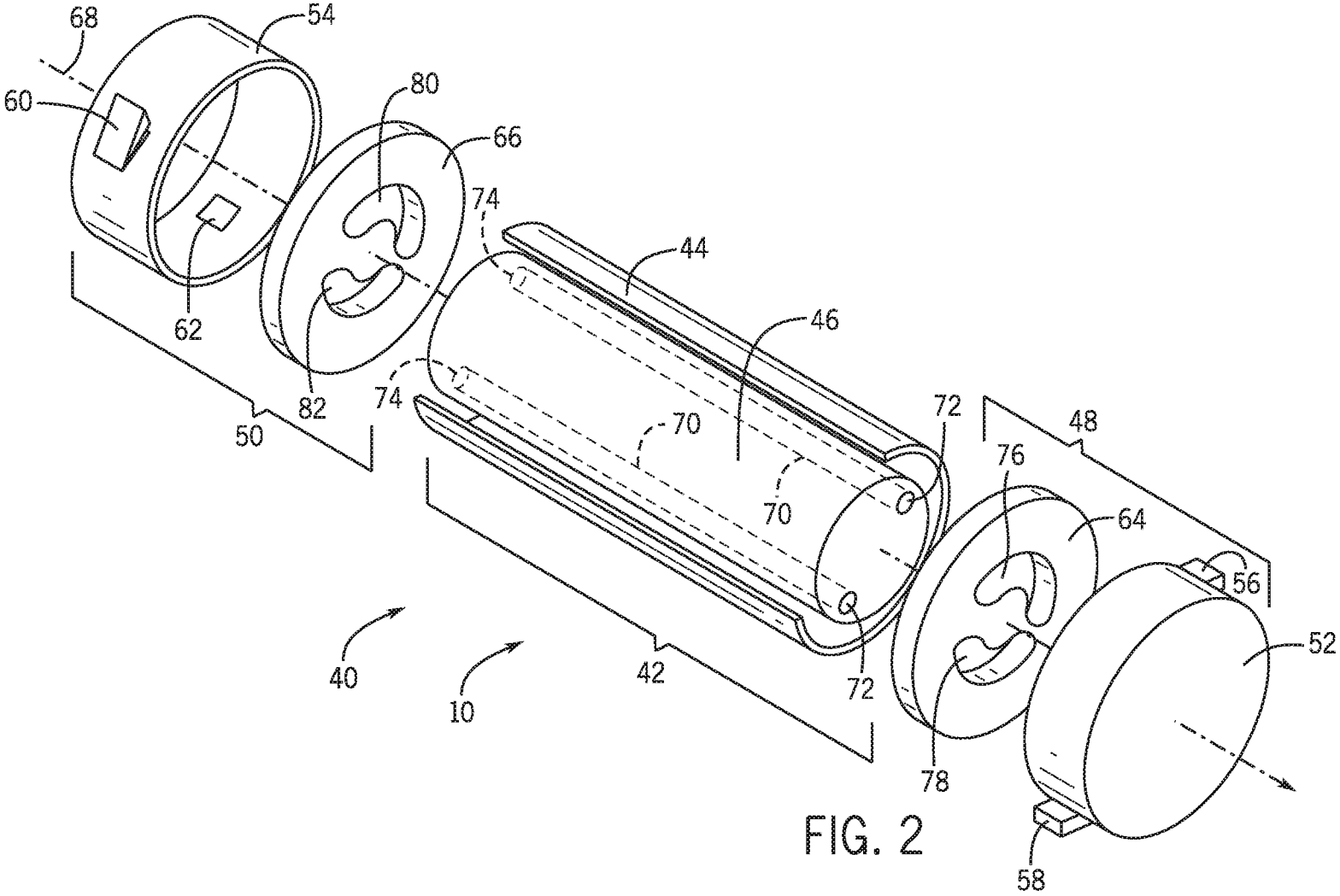
FIG. 2 is an exploded perspective view of an embodiment of a rotary IPX.

FIG. 2 is an exploded perspective view of an embodiment of a rotary isobaric pressure exchanger 40 (rotary IPX) capable of transferring pressure and/or work between first and second fluids (e.g., proppant free fluid and proppant laden fluid) with minimal mixing of the fluids. The rotary IPX 40 may include a generally cylindrical body portion 42 that includes a sleeve 44 (e.g., rotor sleeve) and a rotor 46. The rotary IPX 40 may also include two end caps 48 and 50 that include manifolds 52 and 54, respectively. Manifold 52 includes respective inlet and outlet ports 56 and 58, while manifold 54 includes respective inlet and outlet ports 60 and 62. In operation, these inlet ports 56, 60 enabling the first and second fluids (e.g., proppant free fluid) to enter the rotary IPX 40 to exchange pressure, while the outlet ports 58, 62 enable the first and second fluids to then exit the rotary IPX 40. In operation, the inlet port 56 may receive a high-pressure first fluid, and after exchanging pressure, the outlet port 58 may be used to route a low-pressure first fluid out of the rotary IPX 40. Similarly, the inlet port 60 may receive a low-pressure second fluid (e.g., proppant containing fluid, frac fluid) and the outlet port 62 may be used to route a high-pressure second fluid out of the rotary IPX 40. The end caps 48 and 50 include respective end covers 64 and 66 disposed within respective manifolds 52 and 54 that enable fluid sealing contact with the rotor 46. The rotor 46 may be cylindrical and disposed in the sleeve 44, which enables the rotor 46 to rotate about the axis 68. The rotor 46 may have a plurality of channels 70 extending substantially longitudinally through the rotor 46 with openings 72 and 74 at each end arranged symmetrically about the longitudinal axis 68. The openings 72 and 74 of the rotor 46 are arranged for hydraulic communication with inlet and outlet apertures 76 and 78; and 80 and 82 in the end covers 52 and 54, in such a manner that during rotation the channels 70 are exposed to fluid at high-pressure and fluid at low-pressure. As illustrated, the inlet and outlet apertures 76 and 78; and 80 and 82 may be designed in the form of arcs or segments of a circle (e.g., C-shaped).

In some embodiments, a controller using sensor feedback may control the extent of mixing between the first and second fluids in the rotary IPX 40, which may be used to improve the operability of the fluid handling system. For example, varying the proportions of the first and second fluids entering the rotary IPX 40 allows the plant operator (e.g., system operator) to control the amount of fluid mixing within the hydraulic energy transfer system 10. Three characteristics of the rotary IPX 40 that affect mixing are: (1) the aspect ratio of the rotor channels 70, (2) the short duration of exposure between the first and second fluids, and (3) the creation of a fluid barrier (e.g., an interface) between the first and second fluids within the rotor channels 70. First, the rotor channels 70 are generally long and narrow, which stabilizes the flow within the rotary IPX 40. In addition, the first and second fluids may move through the channels 70 in a plug flow regime with minimal axial mixing. Second, in certain embodiments, the speed of the rotor 46 reduces contact between the first and second fluids. For example, the speed of the rotor 46 may reduce contact times between the first and second fluids to less than approximately 0.15 seconds, 0.10 seconds, or 0.05 seconds. Third, a small portion of the rotor channel 70 is used for the exchange of pressure between the first and second fluids. Therefore, a volume of fluid remains in the channel 70 as a barrier between the first and second fluids. All these mechanisms may limit mixing within the rotary IPX 40. Moreover, in some embodiments, the rotary IPX 40 may be designed to operate with internal pistons or other barriers, either complete or partial, that isolate the first and second fluids while enabling pressure transfer.

FIGS. 3-6 are exploded views of an embodiment of the rotary IPX 40 illustrating the sequence of positions of a single channel 70 in the rotor 46 as the channel 70 rotates through a complete cycle. It is noted that FIGS. 3-6 are simplifications of the rotary IPX 40 showing one channel 70, and the channel 70 is shown as having a circular cross-sectional shape. In other embodiments, the rotary IPX 40 may include a plurality of channels 70 with the same or different cross-sectional shapes (e.g., circular, oval, square, rectangular, polygonal, etc.). Thus, FIGS. 3-6 are simplifications for purposes of illustration, and other embodiments of the rotary IPX 40 may have configurations different from that shown in FIGS. 3-6. As described in detail below, the rotary IPX 40 facilitates pressure exchange between first and second fluids (e.g., proppant free fluid and proppant-laden fluid) by enabling the first and second fluids to briefly contact each other within the rotor 46. In certain embodiments, this exchange happens at speeds that result in limited mixing of the first and second fluids.

Figures 3, 4, 5, 6:
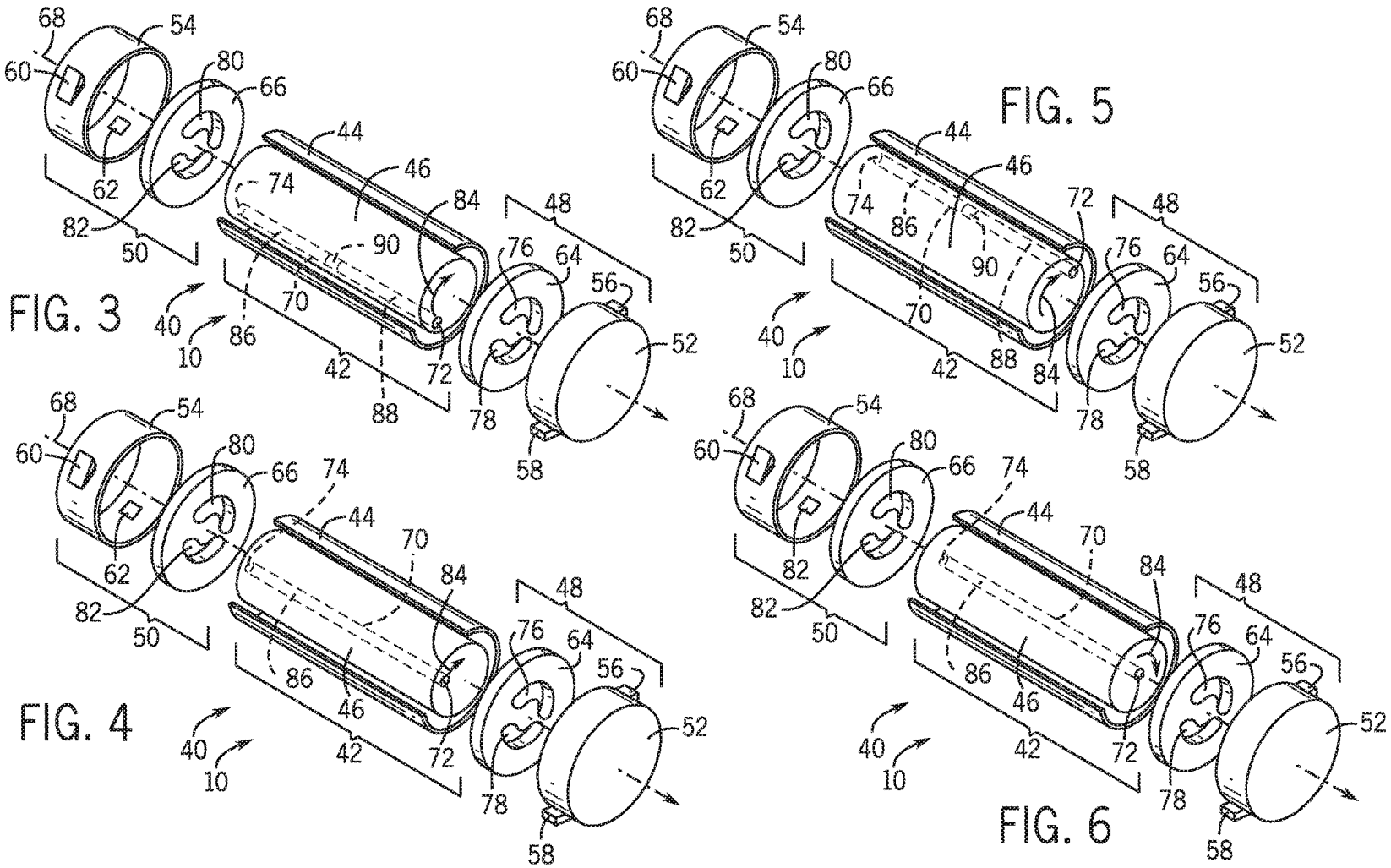
FIG. 3 is an exploded perspective view of an embodiment of a rotary IPX in a first operating position.
FIG. 4 is an exploded perspective view of an embodiment of a rotary IPX in a second operating position.
FIG. 5 is an exploded perspective view of an embodiment of a rotary IPX in a third operating position.
FIG. 6 is an exploded perspective view of an embodiment of a rotary IPX in a fourth operating position.

In FIG. 3, the channel opening 72 is in a first position. In the first position, the channel opening 72 is in fluid communication with the aperture 78 in endplate 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90. The second fluid 86 then drives the first fluid 88 out of the channel 70, through end cover 64, and out of the rotary IPX 40. However, because of the short duration of contact, there is minimal mixing between the second fluid 86 and the first fluid 88.

In FIG. 4, the channel 70 has rotated clockwise through an arc of approximately 90 degrees. In this position, the outlet 74 is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

In FIG. 5, the channel 70 has rotated through approximately 60 degrees of arc from the position shown in FIG. 6. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86 driving the second fluid 86 out of the fluid channel 70 and through the aperture 80 for use in the frac system 8.

In FIG. 6, the channel 70 has rotated through approximately 270 degrees of arc from the position shown in FIG. 6. In this position, the outlet 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Figure 7:
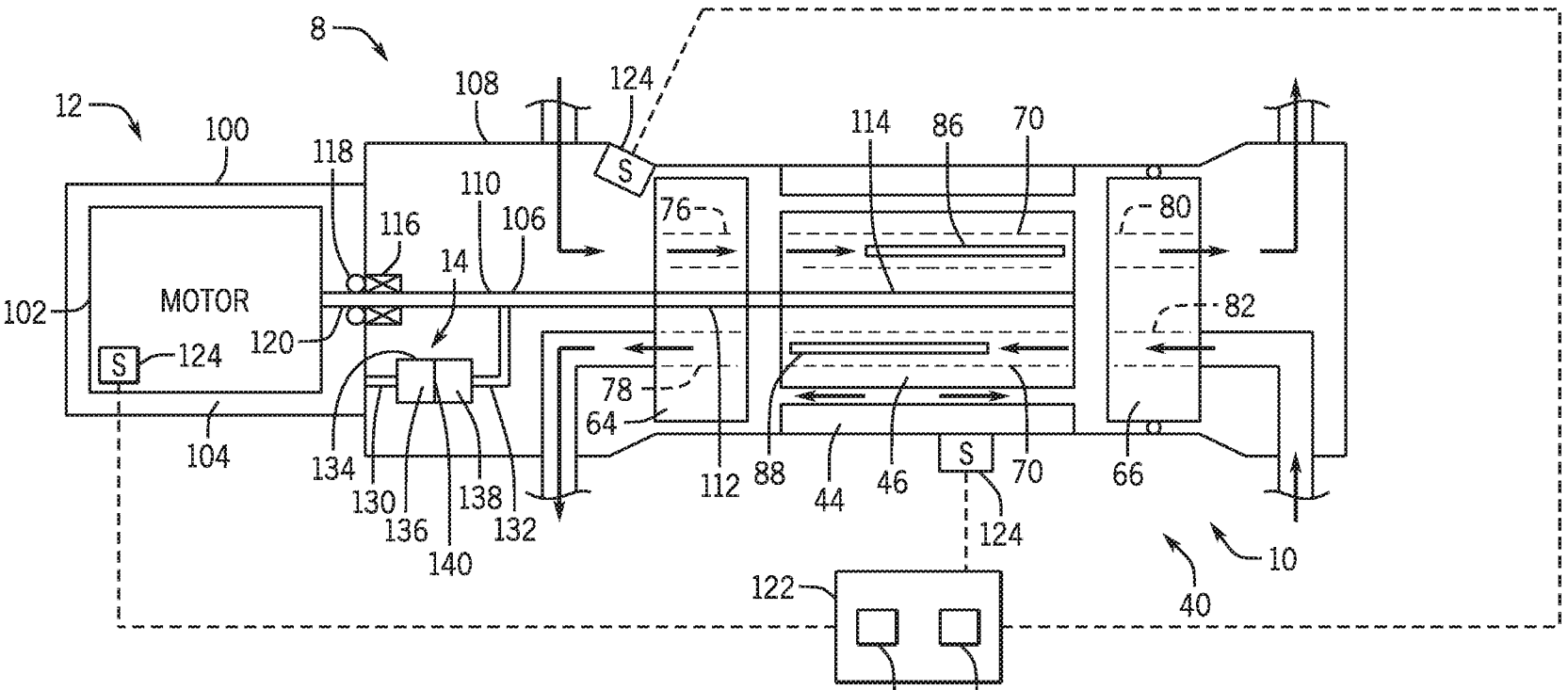
FIG. 7 is a cross-sectional view of an embodiment of a rotary IPX with a motor system and a pressure compensator.

FIG. 7 is a cross-sectional view of an embodiment of a motor system 12 (e.g., external motor system, out-board motor system) coupled to a rotary IPX 40. The motor system 12 may include a motor, an electric motor, a hydraulic motor, a pneumatic motor, another rotary drive, or a combination thereof. The motor system 12 includes a casing 100 that houses or contains the components of the motor system 12 (e.g., the motor). As noted above, the electric motor system 12 also includes a dielectric fluid. That is, the motor system 12 may be a wet motor. In some embodiments, the dielectric fluid may be disposed in an interior portion 102 of the motor system 12, which may include a rotor and a stator. In certain embodiments, the dielectric fluid may be disposed within one or more chambers 104 of the motor system 12. The one or more chambers 104 are disposed within the casing 100 of the motor system 12 and may be disposed within and/or outside of the interior portion 102 of the motor system 12.

The dielectric fluid may include any suitable dielectric fluids. For example, the dielectric fluid may include one or more oils (e.g., mineral oil, synthetic oil, etc.) and/or water (e.g., purified water, deionized water, distilled water, etc.). In certain embodiments, the dielectric fluid may be an insulating fluid. Additionally, the dielectric fluid may be at high pressure. For example, the pressure of the dielectric fluid may be approximately 5,000 kPa to 25,000 kPa, 20,000 kPa to 50,000 kPa, 40,000 kPa to 75,000 kPa, 75,000 kPa to 100,000 kPa. As will be described in more detail below, in some embodiments, the pressure of the dielectric fluid may be substantially the same as the pressure of the high pressure first fluid and/or the high pressure second fluid. For example, the pressure of the dielectric fluid may be within 10%, 9%, 8%, 7%, 6%, 5%, 4%, 3%, 2%, 1%, or less of the pressure of the high pressure first fluid and/or the high pressure second fluid.

As illustrated, the motor system 12 includes a shaft 106 that couples to the rotor 46 through a casing 108 disposed about the rotary IPX 40. Specifically, the shaft 106 extends through an aperture 110 in the casing 108, an aperture 112 in the end cover 64, and an aperture 114 in the rotor 46. To facilitate rotation of the shaft 106, the motor system 12 may also include one or more bearings 116 that support the shaft 106. The bearings 116 may be disposed about any suitable location along the shaft 16. For example, the bearings 116 may be within or outside of the casing 100 of the motor system 12. Further, the bearings 116 may be within or outside of the casing 108 of the rotary IPX 40. In some embodiments, the shaft 106 may extend completely through the rotor 46 and the end cover 66 enabling the shaft 106 to be supported by bearings 116 on opposite sides of the rotor 46. Additionally, one or more shaft seals 118 may be disposed about the shaft 106. The one or more shaft seals 118 may be disposed about any suitable location along the shaft 106 to seal (e.g., separate) the process fluids of the rotary IPX 40 (e.g., the first fluid and/or the second fluid) from the dielectric fluid. For example, the one or more shaft seals 118 may be disposed in the aperture 110 of the casing 108 of the rotary IPX 40 and/or within an aperture 120 of the casing 100 of the motor system 12. In certain embodiments, the one or more shaft seals 118 may be low pressure seals configured to withstand a pressure differential between approximately 500 kPa to 2,000 kPa. For example, as will be described in more detail below, the pressure compensator 14 may balance or equalize the pressure on each face of the shaft seal 118 to reduce the pressure differential across the shaft seal 118.

In operation, the motor system 12 facilitates operation of the rotary IPX 40 by providing torque for grinding through particulates, maintaining the operating speed of the rotor 46, controlling the mixing of fluids within the rotary IPX 40 (e.g., changing the rotating speed of the rotor 46), or starting the rotary IPX 40 with highly viscous or particulate-laden fluids. As illustrated, a controller 122 is operatively coupled to the motor system 12 and one or more sensors 124 (e.g., flow, pressure, torque, rotational speed sensors, acoustic, magnetic, optical, etc.). If the motor system 12 is powered by a variable frequency drive (VFD), the VFD may also be able to provide sensor feedback, in addition to or instead of the sensors 124. In operation, the controller 122 uses feedback from the sensors 124 to control the motor system 12. The controller 122 may include a processor 126 and a memory 128 that stores non-transitory computer instructions executable by the processor 126. For example, as the controller 122 receives feedback from one or more sensors 124, the processor 126 executes instructions stored in the memory 128 to control power output from the motor system 12.

The instructions stored in the memory 128 may include various operating modes for the motor system 12 (e.g., a startup mode, a speed control mode, a continuous power mode, a periodic power mode, etc.). For example, in startup mode, the controller 122 may execute instructions in the memory 128 that signals the motor system 12 to begin rotating the shaft 106. As the motor system 12 operates, the sensors 124 may provide feedback to the controller 122 that indicates whether the shaft 106 is rotating at the proper speed (e.g., rpm) or within a threshold range. When the shaft 98 reaches the desired speed or range, the controller 110 may signal the motor system 12 to stop rotating and/or to stop driving/powering the shaft 98, enabling the first and second fluids flowing through the rotary IPX 40 to take over and provide the rotational power to the rotor 46. The shaft 98 may still rotate, or there may be a ratchet-type mechanism that allows the rotary IPX 40 to spin faster on its own. However, in some embodiments, the rotary IPX 40 may use the motor system 12 to periodically supplement rotation of the rotor 46 (e.g., a periodic power mode).

As noted above, the fluid handling system 8 includes the pressure compensator 14 to equalize or balance the pressure on each face of the shaft seal 118 to reduce or minimize a pressure differential across the shaft seal 118. To balance the pressure on each face of the shaft seal 118, the pressure compensator 14 includes a first fluid passageway 130 in hydraulic communication with the high pressure dielectric fluid of the motor system 12 and a second fluid passageway 132 in hydraulic communication with a high pressure process fluid of the rotary IPX 40. In some embodiments, the high pressure process fluid of the rotary IPX 40 may include the first fluid 88 (e.g., substantially proppant-free fluid, substantially particulate-free fluid, non-abrasive fluid, clean fluid, etc.). That is, it may be desirable to dispose the shaft seal 118 proximal to the first fluid 88, rather than the second fluid 86 (e.g., proppant-laden fluid, particulate-laden fluid, abrasive fluid, etc.), to reduce wear and degradation of the shaft seal 118 caused by particles and debris. However, in some embodiments, the high pressure process fluid may include the second fluid 86. The high pressure process fluid may be 5,000 kPa to 25,000 kPa, 20,000 kPa to 50,000 kPa, 40,000 kPa to 75,000 kPa, 75,000 kPa to 100,000 kPa, or greater.

Additionally, the pressure compensator 14 includes a housing 134 having a first chamber 136 in hydraulic communication with the first fluid passageway 130 and a second chamber 138 in hydraulic communication with the second fluid passageway 132. Accordingly, the first chamber 136 may be configured to contain or house the high pressure dielectric fluid, and the second chamber 138 may be configured to contain or house the high pressure process fluid. Further, the pressure compensator 14 includes a barrier (e.g., a hydraulic barrier) 140 separating the first chamber 136 from the second chamber 138 and thus, separating the high pressure dielectric fluid from the high pressure process fluid.

The barrier 140 reduces, blocks, or limits hydraulic communication (e.g., fluid leakage) between the dielectric fluid and the process fluid within the pressure compensator 14, while enabling pressure communication between the dielectric fluid and the process fluid within the pressure compensator 14. In particular, at least a portion of the barrier 140 is movable relative to the housing 134 to transfer pressure between the first and second chambers 136 and 138 to balance or equalize the pressure between the dielectric fluid and the process fluid in the first and second chambers 136 and 138, respectively. For example, in some embodiments, the barrier 140 may be flexible and/or elastomeric and may be configured to expand and contract due to the pressures. In some embodiments, the barrier 140 may be rigid and may be configured to translate relative to the housing 134 due to the pressures. As will be described in more detail below, the barrier 140 may include a piston, a diaphragm, a bladder, a spring, or a combination thereof.

The housing 134, the first fluid passageway 130, and/or second fluid passageway 132 may be internal and/or external to the casing 100. Further, the housing 134, the first fluid passageway 130, and/or second fluid passageway 134 may be internal and/or external to the casing 108. In some embodiments, at least a portion of the housing 134, the first fluid passageway 130, and/or the second fluid passageway 132 may be formed by apertures (e.g., openings, channels, etc.) within the casing 100 and/or the casing 108. In certain embodiments, the first and second passageways 130 and 132 may include conduits (e.g., pipes, tubes, etc.).

Figure 8:
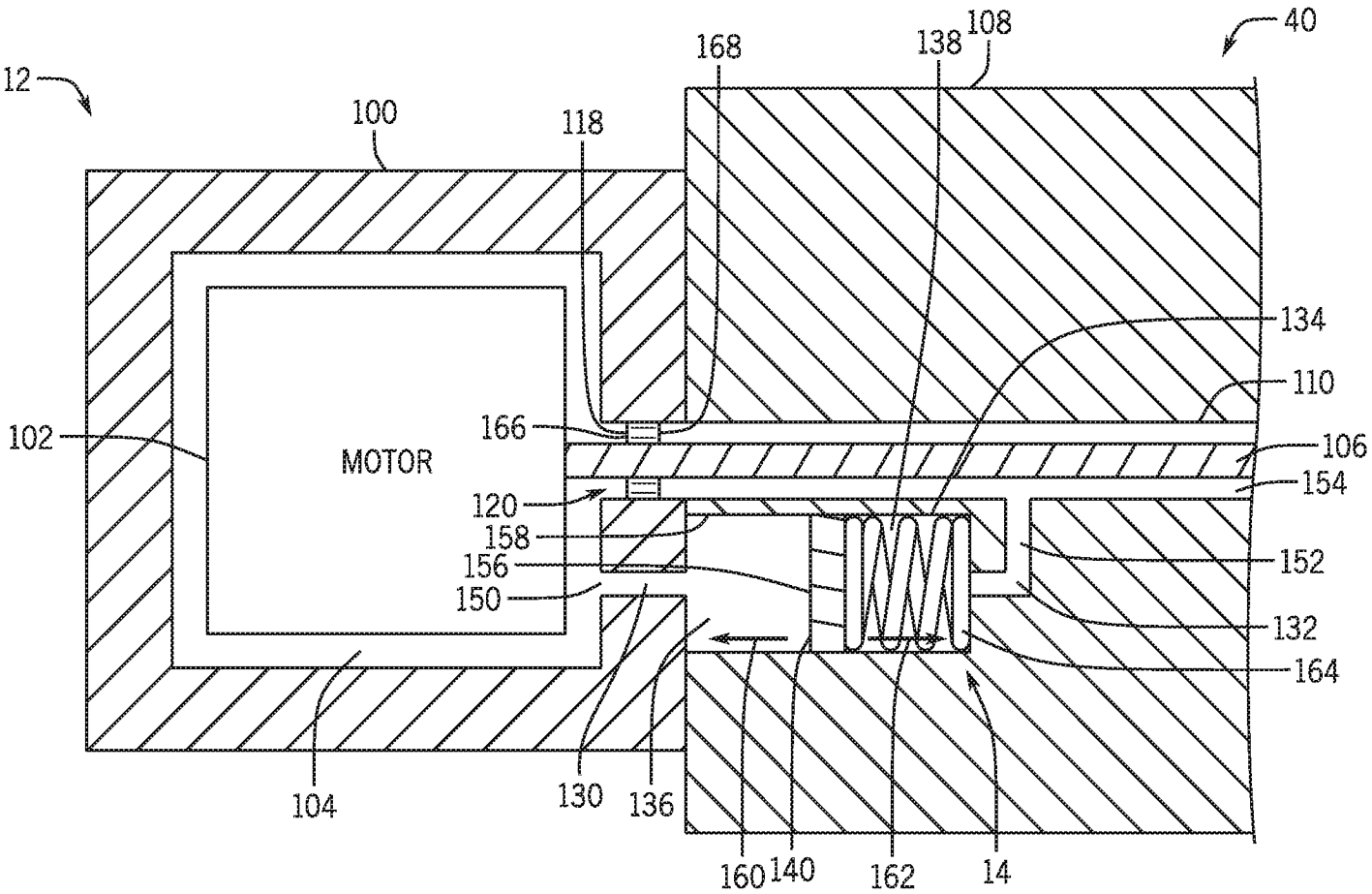
FIG. 8 is a partial cross-sectional view of an embodiment of a rotary IPX with a motor system and a pressure compensator.

FIG. 8 is a partial cross-sectional view of an embodiment of the rotary IPX 40, the motor system 12, and the pressure compensator 14. In the embodiment of FIG. 8, the housing 134 of the pressure compensator 14 is disposed within the casing 108 of the rotary IPX 40. The housing 134 of the pressure compensator 14 may be disposed directly adjacent to the casing 100 of the motor system 12, as illustrated, or spaced apart from the casing 100. Additionally, the first fluid passageway 130 is formed through an aperture 150 (e.g., an opening, a channel, etc.) of the casing 100 of the motor system 12. The aperture 150 may be disposed about any suitable location of the casing 100. In some embodiments, it may be desirable to have the aperture 150 proximate to the shaft seal 118. The first fluid passageway 130 extends from the aperture 150 in the casing 100 to the first chamber 136. In some embodiments, the first fluid passageway 130 may also extend through an aperture in the casing 108 that is between the aperture 150 in the casing 100 and the first chamber 136. The first fluid passageway 130 may be formed in a variety of manners and disposed in a variety of locations. Regardless of the form or location of the first fluid passageway 130, the first fluid passageway 130 establishes hydraulic communication between dielectric fluid disposed in the casing 100 (e.g., the dielectric fluid in the chamber 104) and dielectric fluid disposed in the first chamber 136.

Further, the second fluid passageway 132 is formed through an aperture 152 in the casing 108 of the rotary IPX 40. As illustrated, the second fluid passageway 132 (e.g., the aperture 152) extends from the second chamber 138 to an annulus 154 between the shaft 106 and the opening 110 in the casing 108. The annulus 154 includes high pressure process fluid of the rotary IPX 40, which will be described in more detail below. The aperture 152 may connect with the annulus 154 at any suitable location about the annulus 154. In some embodiments, it may be desirable to have the aperture 152 connect with the annulus 154 at a location that is proximal to the shaft seal 118. The second fluid passageway 132 may be formed in a variety of manners and disposed in a variety of locations. Regardless of the form or location of the second fluid passageway 132, the second fluid passageway 132 establishes hydraulic communication between high pressure process fluid of the rotary IPX 40 disposed in the annulus 154 and high pressure process fluid of the rotary IPX 40 disposed in the second chamber 138.

The high pressure process fluid in the annulus 154 may include the first fluid 88 (e.g., substantially proppant-free fluid, substantially particulate-free fluid, non-abrasive fluid, clean fluid, etc.). In some embodiments, the high pressure process fluid may include the second fluid 86 (e.g., proppant-laden fluid, particulate-laden fluid, abrasive fluid, etc.) or may include both the first fluid 88 and the second fluid 86. In certain embodiments, the pressure of the high pressure process fluid may be substantially the same pressure as the high pressure first fluid 88 entering the rotary IPX 40 through the inlet port 56. In some embodiments, the pressure of the high pressure process fluid may be based on the pressure of the high pressure first fluid 88 entering the rotary IPX 40 through the inlet port 56 and the pressure of the low pressure first fluid 88 exiting the rotary IPX 40 through the outlet port 58. In some embodiments, the pressure of the high pressure process fluid may be 5,000 kPa to 25,000 kPa, 20,000 kPa to 50,000 kPa, 40,000 kPa to 75,000 kPa, 75,000 kPa to 100,000 kPa, or greater.

Further, as noted above, in some embodiments, the pressure of the high pressure dielectric fluid may be substantially the same as the pressure of the high pressure process fluid. In particular, the pressure of the high pressure dielectric fluid may be within 10%, 9%, 8%, 7%, 6%, 5%, 4%, 3%, 2%, 1%, or less of the pressure of the high pressure process fluid. Further, in some embodiments, it may be desirable to bias the pressure from the high pressure dielectric fluid toward the high pressure process fluid. By biasing the pressure from the high pressure dielectric fluid toward high pressure process fluid, the high pressure dielectric fluid may flow from the motor system 12 to the rotary IPX 40 if there is any leakage across the shaft seal 118, and leakage of the high pressure process fluid from the rotary IPX 40 to the motor system 12 across the shaft seal 116 may be reduced, minimized, or avoided. Accordingly, in some embodiments, the pressure of the high pressure dielectric fluid may be greater than the pressure of the high pressure process fluid by 10%, 9%, 8%, 7%, 6%, 5%, 4%, 3%, 2%, 1%, or less.

As illustrated, the barrier 140 of the pressure compensator 14 includes a piston 156. The piston 156 is sealingly engaged with an interior surface 158 of the housing 134. The seal between the piston 156 and the interior surface 158 may be achieved by various means which can include one or more o-rings, piston rings, etc. The piston 156 separates the high pressure dielectric fluid in the first chamber 136 from the high pressure process fluid in the second chamber 138. In particular, the piston 156 reduces, minimizes, or blocks hydraulic communication between the high pressure dielectric fluid in the first chamber 136 and the high pressure process fluid in the second chamber 138, while enabling pressure communication between the high pressure dielectric fluid in the first chamber 136 from the high pressure process fluid in the second chamber 138. Specifically, the piston 156 may translate relative to the housing 134 as indicated by arrows 160 and 162 to transfer pressure from the first chamber 136 to the second chamber 138 and vice versa. In some embodiments, the piston 156 may be coupled to a spring 164. By transferring pressure between the first chamber 136 and the second chamber 138, the piston 156 may equalize or balance the pressures of the high pressure dielectric fluid and the high pressure process fluid and, as a result, may decrease or minimize a pressure differential across a first face 166 of the shaft seal 118 that faces the motor system 10 and a second face 168 of the shaft seal 118 that faces the rotary IPX 40. Accordingly, the first face 166 of the shaft seal 118 may be exposed to, adjacent to, and/or in contact with the dielectric fluid disposed in the casing 100 of the motor system 10. Additionally, the second face 168 of the shaft seal 118 may be exposed to, adjacent to, and/or in contact with a process fluid (e.g., a high pressure process fluid, the first fluid, and/or the second fluid) disposed in the casing 108 of the rotary IPX 40 (e.g., a process fluid surrounding the shaft 106).

Figure 9:
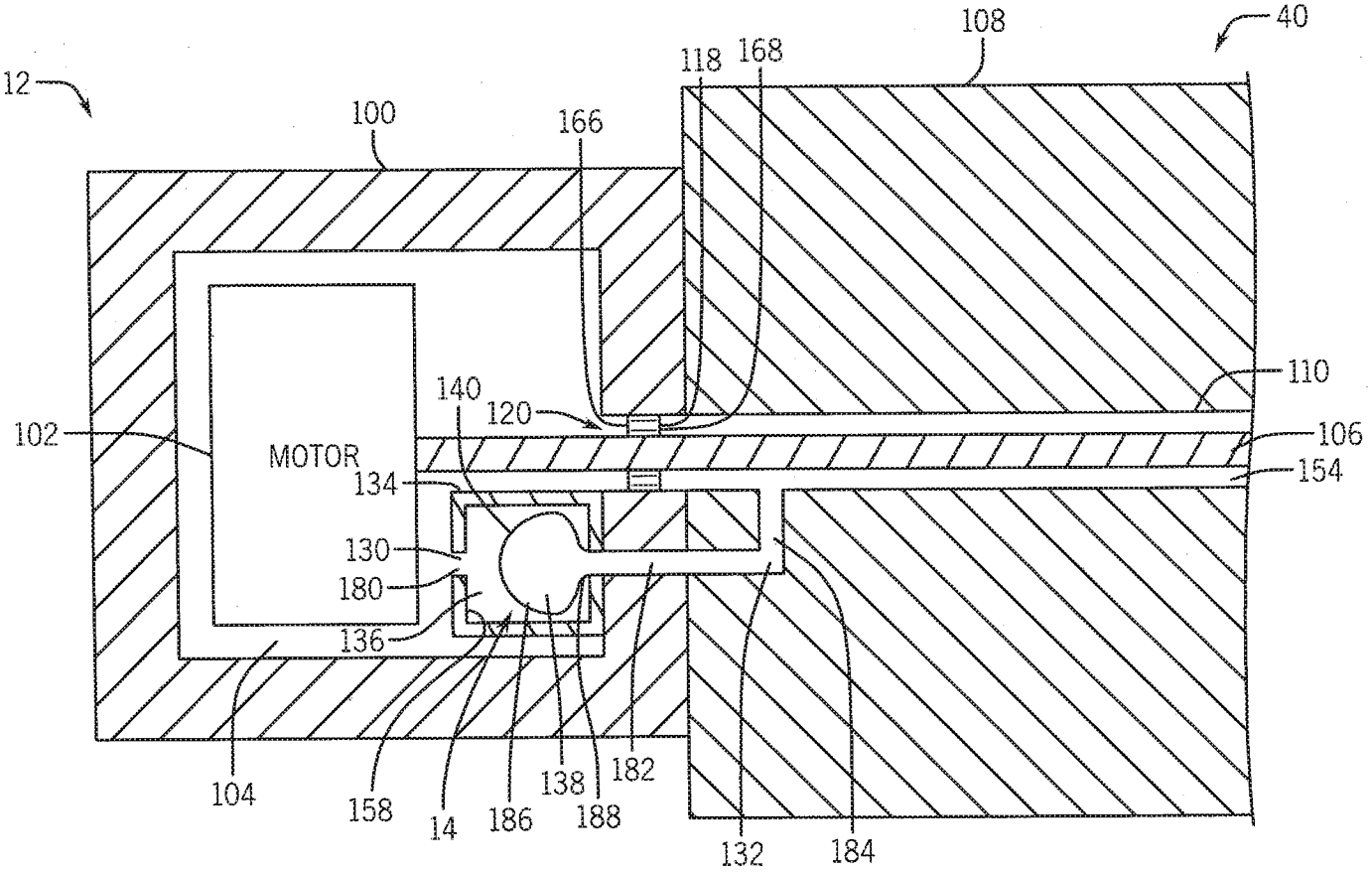
FIG. 9 is a partial cross-sectional view of an embodiment of a rotary IPX and with a motor system and a pressure compensator.

FIG. 9 is a partial cross-sectional view of an embodiment of the rotary IPX 40, the motor system 12, and the pressure compensator 14. In the embodiment of FIG. 9, the housing 134 of the pressure compensator 14 is disposed within the casing 100 of the motor system 10. The pressure compensator 14 may be disposed in any suitable location in the casing 100, such as in the chamber 104 of the motor system 12, as illustrated. Further, the housing 134 of the pressure compensator 14 may be disposed directly adjacent to the casing 108 of the rotary IPX 40, as illustrated, or spaced apart from the casing 108. Additionally, the first fluid passageway 130 is formed through an aperture 180 (e.g., an opening, a channel, etc.) of the housing 134. The aperture 180 may be disposed about any suitable location of the housing 134. In some embodiments, it may be desirable to have the aperture 180 proximate to the shaft seal 118. The first fluid passageway 130 extends from the aperture 180 in the housing 134 to the first chamber 136. As noted above, the first fluid passageway 130 establishes hydraulic communication between dielectric fluid disposed in the casing 100 (e.g., the dielectric fluid in the chamber 104) and dielectric fluid disposed in the first chamber 136.

Further, the second fluid passageway 132 is formed through an aperture 182 in the casing 100 of the motor system 12 and through an aperture 184 in the casing 108 of the rotary IPX 40. As noted above, the second fluid passageway 132 extends from the second chamber 138 to the annulus 154 between the shaft 106 and the opening 110 in the casing 108. The aperture 184 in the casing 108 may connect with the annulus 154 at any suitable location about the annulus 154. In some embodiments, it may be desirable to have the aperture 184 connect with the annulus 154 at a location that is proximal to the shaft seal 118. As noted above, the second fluid passageway 132 establishes hydraulic communication between high pressure process fluid of the rotary IPX 40 disposed in the annulus 154 and high pressure process fluid of the rotary IPX 40 disposed in the second chamber 138.

As illustrated, the barrier 140 of the pressure compensator 14 includes a bladder 186. The bladder 186 separates the high pressure dielectric fluid in the first chamber 136 from the high pressure process fluid in the second chamber 138. In particular, the first chamber 136 or the second chamber 138 may be disposed in the bladder 186. For example, as illustrated, the second chamber 138 is disposed in the bladder and an opening 188 (e.g., a neck portion) of the bladder 186 is disposed about the aperture 182 in the casing 100 such that the second fluid passageway 132 is in hydraulic communication with the second chamber 138 disposed in the bladder 186. The opening 188 may be secured to the interior surface 158 of the housing 134. In some embodiments, the first chamber 136 may be disposed in the bladder 186, and the opening of the bladder 186 may be disposed about the aperture 180 for hydraulic communication with the first fluid passageway 130. The bladder 186 may be manufactured from one or more liquid impervious and flexible materials, such as rubber. In some embodiments, the elasticity of the bladder 186 may provide a small pressure differential, so it may be advantageous to have the opening 188 of the bladder 186 in hydraulic communication with the first fluid passageway 130 or in hydraulic communication with the second fluid passageway 132. The bladder 186 reduces, minimizes, or blocks hydraulic communication between the high pressure dielectric fluid in the first chamber 136 and the high pressure process fluid in the second chamber 138, while enabling pressure communication between the high pressure dielectric fluid in the first chamber 136 from the high pressure process fluid in the second chamber 138. Specifically, the bladder 186 may expand and contract to transfer pressure from the first chamber 136 to the second chamber 138 and vice versa. By transferring pressure between the first chamber 136 and the second chamber 138, the bladder 186 may equalize or balance the pressures of the high pressure dielectric fluid and the high pressure process fluid and, as a result, may decrease or minimize a pressure differential across the first and second faces 166 and 168.

As described detail above, a fluid handling system may include a hydraulic energy transfer system to exchange pressures between first and second fluids and a motor system coupled to the hydraulic energy transfer system to facilitate rotation of the hydraulic energy transfer system. The motor system may be coupled to the hydraulic energy transfer system via a shaft and a shaft seal, and the motor system may include a high pressure dielectric fluid. Additionally, the fluid handling system may include a pressure compensation system (e.g., a pressure compensator, a pressure balancer, a pressure equalizer, etc.) that may balance or equalize the pressure between the high pressure dielectric fluid of the motor system and high pressure process fluid of the hydraulic energy transfer system. By equalizing or balancing the pressure between the high pressure dielectric fluid and the high pressure process fluid, the pressure compensation system may reduce or minimize a pressure differential between a first face of the shaft seal facing the motor system and a second face of the shaft seal facing the hydraulic energy transfer system. As such, the pressure compensation system may enable the use of a low pressure shaft seal (e.g., between 500 kPa to 2,000 kPa) and may reduce leakage of fluid across the shaft seal. Further, the pressure compensation system may reduce wear and degradation of the shaft seal and may reduce the occurrence of extrusion of the shaft seal, which may increase the lifespan of the shaft seal.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hydraulic energy transfer system configured to exchange pressures between a first fluid and a second fluid;

a motor system configured to power the hydraulic energy transfer system, wherein motor system comprises a casing, a motor disposed in the casing, and a dielectric fluid disposed in the casing;

a shaft coupling the motor system and the hydraulic energy transfer system;

a shaft seal disposed about the shaft;

a pressure compensator configured to reduce a pressure differential across the shaft seal, wherein the pressure compensator comprises:

a first chamber in hydraulic communication with the first fluid;

a second chamber in hydraulic communication with the dielectric fluid; and a hydraulic barrier disposed between the first and second chambers, wherein the hydraulic barrier is configured to separate the first fluid in the first chamber and the dielectric fluid in the second chamber and configured to balance a first pressure of the first fluid in the first chamber with a second pressure of the dielectric fluid in the second chamber; and a fluid passageway in hydraulic communication with the dielectric fluid disposed in the casing of the motor system and the second chamber, wherein the second fluid passageway directly supplies the dielectric fluid to the second chamber from an interior of the casing.

2. The system of claim 1, wherein the motor comprises an electric motor.

3. The system of claim 1, wherein the hydraulic barrier comprises a flexible barrier.

4. The system of claim 3, wherein the flexible barrier comprises a diaphragm or a bladder.

5. The system of claim 1, wherein the hydraulic barrier comprises a rigid barrier.

6. The system of claim 5, wherein the rigid barrier comprises a piston.

7. The system of claim 1, wherein the second pressure of the dielectric fluid is within approximately 10 percent of the first pressure of the first fluid.

8. The system of claim 1, wherein the first fluid comprises a non-abrasive fluid, and the second fluid comprises an abrasive fluid.

9. The system of claim 1, wherein the pressure compensator is disposed within the casing of the motor system.

10. The system of claim 1, wherein the pressure compensator is disposed within a casing of the hydraulic energy transfer system.

11. A system, comprising:

a rotary isobaric pressure exchanger (IPX) configured to exchange pressures between a first fluid and a second fluid, wherein the rotary IPX comprises a first casing and a rotor disposed in the first casing;

a motor system configured to power the rotary IPX, wherein the motor system comprises a second casing, a motor disposed in the second casing, and a dielectric fluid disposed in the second casing;

a shaft coupling the motor and the rotor;

a shaft seal disposed about the shaft, wherein the shaft seal is configured to separate the first fluid and the dielectric fluid;

a pressure compensator configured to reduce a pressure differential across the shaft seal, wherein the pressure compensator comprises:

a first chamber configured to receive the first fluid at a first pressure;

a second chamber configured to receive the dielectric fluid at a second pressure; and a hydraulic barrier disposed between the first and second chambers, wherein the hydraulic barrier is configured to separate the first fluid in the first chamber and the dielectric fluid in the second chamber and configured to balance the first pressure of the first fluid and the second pressure of the dielectric fluid; and a fluid passageway in hydraulic communication with the dielectric fluid disposed in the second casing of the motor system and the second chamber, wherein the second fluid passageway directly supplies the dielectric fluid to the second chamber from an interior of the second casing.

12. The system of claim 11, wherein the hydraulic barrier comprises a piston, a diaphragm, or a bladder.

13. The system of claim 11, wherein the pressure compensator comprises a housing configured to house the first chamber and the second chamber, and wherein the hydraulic barrier is configured to move relative to the housing to balance the first pressure of the first fluid and the second pressure of the dielectric fluid.

14. The system of claim 11, wherein the second pressure of the dielectric fluid is greater than the first pressure of the first fluid.

15. A system, comprising:

a rotary isobaric pressure exchanger (IPX) configured to exchange pressures between a first fluid and a second fluid, wherein the rotary IPX comprises a first casing and a rotor disposed in the first casing;

a motor system configured to power the rotary IPX, wherein the motor system comprises a second casing, a motor disposed in the second casing, and a dielectric fluid disposed in the second casing;

a shaft coupling the motor and the rotor;

a shaft seal disposed about the shaft, wherein the shaft seal comprises a first face configured to contact the first fluid and a second face configured to contact the dielectric fluid, and wherein the shaft seal is configured to block leakage of the first fluid into the motor system;

a pressure compensator configured to reduce a pressure differential across the first and second faces of the shaft seal, wherein the pressure compensator comprises:

a first chamber configured to receive the first fluid at a first pressure;

a second chamber configured to receive the dielectric fluid at a second pressure, wherein the second pressure is greater than the first pressure; and a hydraulic barrier disposed between the first and second chambers, wherein the hydraulic barrier is configured to separate the first fluid in the first chamber and the dielectric fluid in the second chamber and configured to balance the first pressure of the first fluid and the second pressure of the dielectric fluid;

a first fluid passageway in hydraulic communication with the first fluid disposed in first casing of the rotary IPX and the first chamber; and a second fluid passageway in hydraulic communication with the dielectric fluid disposed in the second casing of the motor system and the second chamber, wherein the second fluid passageway directly supplies the dielectric fluid to the second chamber from an interior of the second casing.

16. The system of claim 15, wherein the pressure compensator is disposed in the second casing of the motor system, and wherein the first fluid passageway extends through the first casing of the rotary IPX and the second casing of the motor system.

* * * * *